US006178887B1

(12) United States Patent
Hachiya et al.

(10) Patent No.: US 6,178,887 B1
(45) Date of Patent: Jan. 30, 2001

(54) LEAK-FREE INK SUPPLY APPARATUS FOR KEYLESS PRINTING

(75) Inventors: Tadashi Hachiya; Masahiko Miyoshi; Yukitoshi Takahashi, all of Kanagawa (JP)

(73) Assignee: Kabushiki Kaisha Tokyo Kikai Seisakusho, Tokyo (JP)

( * ) Notice: Under 35 U.S.C. 154(b), the term of this patent shall be extended for 0 days.

(21) Appl. No.: 09/350,091

(22) Filed: Jul. 9, 1999

(30) Foreign Application Priority Data

Jul. 27, 1998 (JP) ..... 10-210584

(51) Int. Cl.[7] ..... B41F 31/00; B41F 31/02

(52) U.S. Cl. ..... 101/351.2; 101/351.4; 101/364; 101/352.03; 101/352.05

(58) Field of Search ..... 101/160, 161, 101/165, 204, 207–209, 314, 315, 320, 321, 326, 331, 350.1, 350.5, 351.1–351.4, 352.01–352.05, 363–365, 367; 118/261

(56) References Cited

U.S. PATENT DOCUMENTS 1,644,723 * 10/1927 Halliwell ..... 101/363
3,630,146 * 12/1971 Shields ..... 101/351
3,746,957 * 7/1973 Forster et al. ..... 318/696
3,877,369 * 4/1975 D'Amato et al. ..... 101/157
4,960,052 * 10/1990 Junghans ..... 101/350
5,533,450 * 7/1996 Hachiya et al. ..... 101/365
5,603,262 * 2/1997 Uera et al. ..... 101/350
5,709,148 * 1/1998 Uera et al. ..... 101/350
5,722,324 * 3/1998 Nishiwaki et al. ..... 101/363
5,842,416 * 12/1998 Olawsky et al. ..... 101/350.1

FOREIGN PATENT DOCUMENTS 9-226095 9/1997 (JP) .

* cited by examiner

*Primary Examiner*—Kimberly Asher
(74) *Attorney, Agent, or Firm*—Arent Fox Kintner Plotkin & Kahn, PLLC

(57) ABSTRACT

An ink fountain has one side closed by a fountain roller constantly exposed to the ink contained therein. Forming a part of the fountain bottom, a blade assembly defines in combination with the fountain roller an ink outlet which is to be closed and opened as the blade assembly travels toward and away from the fountain roller. Sprung away from the fountain roller, the blade assembly is moved toward the fountain roller against the spring bias by at least two linear actuators such as double-ended-rod fluid actuators spaced from each other in the axial direction of the fountain roller. The output members of the linear actuators, such as the reciprocable cylinders of the double-ended-rod fluid actuators, are rigidly interconnected as by a simple link, being aligned parallel to the fountain roller axis, for synchronous operation, thereby conjointly causing the travel of the blade assembly into leak-free contact with the fountain roller.

13 Claims, 7 Drawing Sheets

LEAK-FREE INK SUPPLY APPARATUS FOR KEYLESS PRINTING

BACKGROUND OF THE INVENTION

This invention deals with means including an ink fountain and forming parts of an inking mechanism for printing presses, particularly those having a printing plate wrapped around a plate cylinder. More particularly, the invention concerns ink supply means suitable for "keyless" printing, by which is meant the printing processes that demand no control of ink supply to suit specific density distributions as required by the images on the printing plates but that need only ink film of constant thickness at all times.

Japanese Unexamined Patent Publication No. 9-226095 is hereby cited as teaching an ink supply apparatus closest to the instant invention. This prior art apparatus includes an ink fountain having an open side closed by a fountain roller, which is therefore constantly directly exposed to the ink in the fountain. The ink is transferred from the fountain roller to a knurled cylinder via one or more ink rollers, from which knurled cylinder excess ink is doctored off and back into the ink fountain. Ink transfer from the knurled cylinder to the printing plate on a plate cylinder is accomplished, typically, by two ink rollers each in rolling contact with both knurled cylinder and plate cylinder. Ideally, the ink film thus formed on the plate cylinder is of constant thickness throughout its axial dimension.

Further, according to the prior art, the ink fountain has its bottom formed, either in part or in whole, by a blade movable into and out of abutment against the surface of the fountain roller to close and open the ink outlet therebetween. Drive means are mounted to the ink fountain for linearly moving the blade toward and away from the fountain roller.

Difficulties have been experienced, however, in moving the fountain bottom blade into neat, leak-free contact with the fountain roller, particularly in usual cases where the blade, and of course the fountain roller as well, are elongated axially of the fountain roller. In such cases there have been provided two or more drive mechanisms in spaced positions along the fountain roller axis. The noted prior art teaches the use of drive mechanisms that are independently adjustable for moving the blade parallel to the fountain roller. Such adjustable drive mechanisms are complex and costly in construction, inherently susceptible to troubles and malfunctionings because of precise synchronization sought after, and have required much time and labor for repair and maintenance.

As an additional disadvantage, even when themselves functioning normally, the drive mechanisms have been easy to cause uneven travel of the blade due to differences in load thereon. Ink has often leaked from between the blade and the fountain roller when, with the cessation of printing operation, the former is forced into contact with the latter because of nonparallel relationship therebetween.

SUMMARY OF THE INVENTION

The present invention seeks to accomplish, in ink supply apparatus of the kind defined, leak-free contact between blade and fountain roller by use of means that are materially simplified, inexpensive, and maintenance-free in construction and positive and reliable in operation.

Briefly, the invention may be summarized as an ink supply apparatus comprising an ink fountain for containing ink, and a fountain roller closing one side of the ink fountain and constantly exposed to the ink. Forming at least part of the fountain bottom, a blade means is provided which are movable toward and away from the surface of the fountain roller for closing and opening an ink outlet defined by and between the fountain roller and the blade means. The blade means is resiliently biased away from the fountain roller. A plurality of blade drive means are disposed in spaced positions along the fountain roller axis and act between the ink fountain and the blade means for moving the blade means into engagement with the surface of the fountain roller against the force of the resilient means in order to close the ink outlet. A link means is provided for mechanically linking the blade drive means to each other in order to synchronize the operations thereof and hence to assure leak-free contact of the blade means with the fountain roller.

The mechanical linking of the two or more blade drive means constitutes perhaps the most pronounced feature of the instant invention. Since a simple straight link is the easiest, cheapest, and most reliable way of linking, it is considered desirable that the blade drive means include linear actuators that are aligned parallel to the fountain roller axis, the aligned output members of such actuators being capable of rigid interconnection by a straight link.

Thus, in a preferred embodiment of the invention, each of two identical blade drive means is comprised of a blade pusher coupled to the blade means and constrained to linear travel with the blade means toward and away from the fountain roller, a linear actuator mounted to the ink fountain and having an output member reciprocably movable relative to the ink fountain in a direction parallel to the axis of the fountain roller, and cam means for translating the motion of the output member of the linear actuator in the direction parallel to the axis of the fountain roller into the motion of the blade pusher at right angles with the axis of the fountain roller. The output members of both linear actuators are interconnected by a straight link.

Most desirably, the linear actuators take the form,of double-ended-rod fluid actuators each comprising a double-ended rod immovably mounted to the ink fountain, a piston formed on the double-ended rod, and a cylinder slidably fitted over the piston so as to define a pair of fluid chambers on opposite sides of the piston, the cylinder being capable of linear reciprocation relative to the ink fountain in a direction parallel to the axis of the fountain roller. It is therefore the cylinders, not the double-ended piston rods, that constitute the output members of these fluid actuators. Both fluid actuators have their cylinders linked together for synchronization.

No means other than the straight link, and no fine, adjustment of the individual actuators, are required for moving the blade means into leak-free contact with the fountain roller. Moreover, constantly held parallel to the fountain roller, the blade means is smoothly and quickly movable to open and close the ink outlet. It will also be apparent that the invention permits remote control of such operation of the ink fountain apparatus in association with the operation of the complete printing press with which the apparatus is to be incorporated.

The above and other objects, features and advantages of this invention and the manner of achieving them will become more apparent, and the invention itself will best be understood, from a study of the following description and attached claims, with reference had to the accompanying drawings showing a preferable embodiment of the invention.

DESCRIPTION OF THE PREFERRED EMBODIMENT

General

Figure 1:
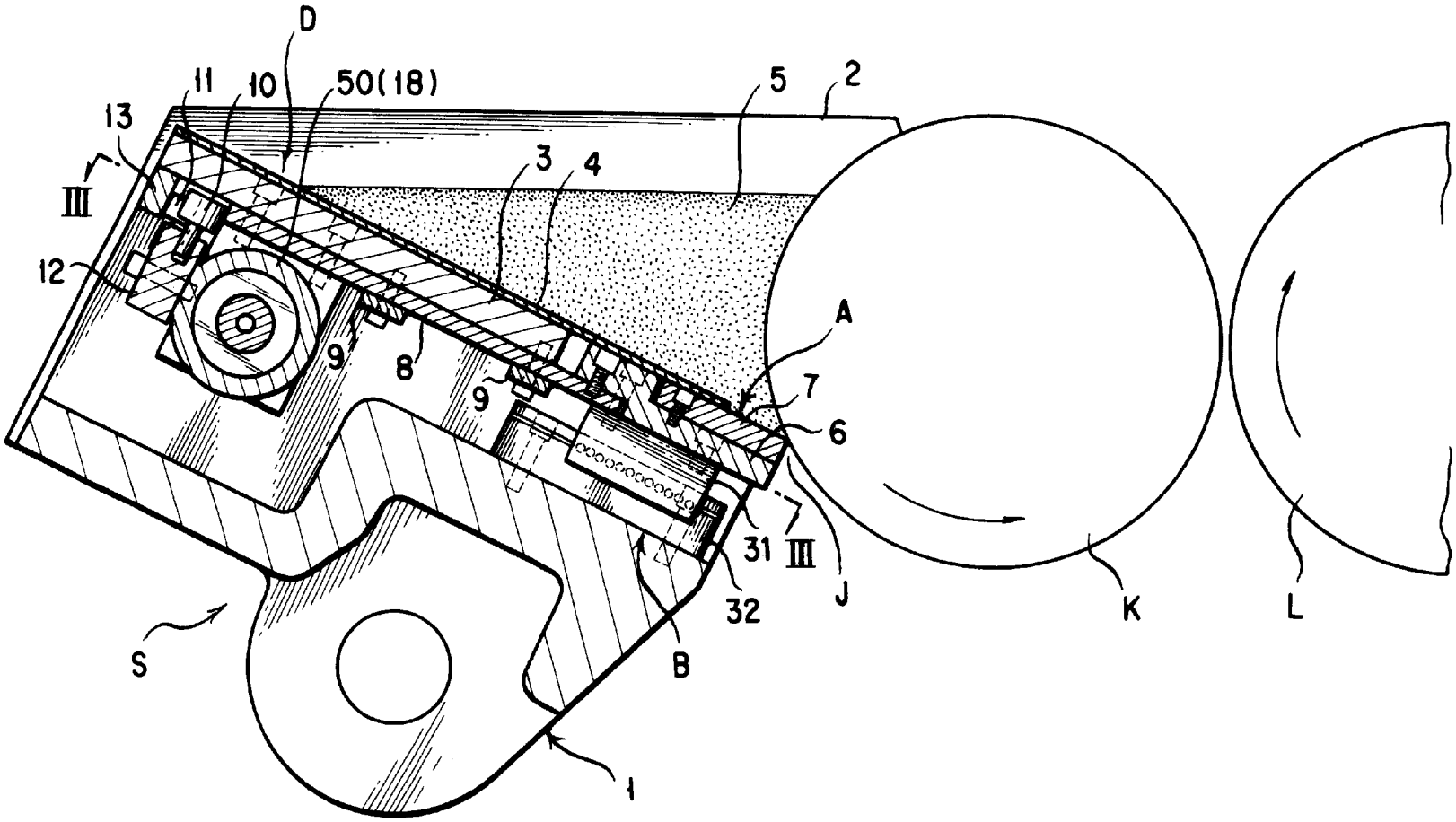
FIG. 1 is a vertical section through the ink supply apparatus constructed to embody the principles of the-present invention.

Generally designated S in FIG. 1, the representative ink supply apparatus according to this invention is therein shown to comprise an ink fountain 1 and a fountain roller K. The invention particularly concerns the ink fountain 1, the fountain roller being of any known or suitable design. Also depicted fragmentarily in this figure is an ink roller L to which ink is transferred from the fountain roller. How ink transfer from the ink roller to a plate cylinder, not shown, or to equivalent means falls outside the purview of the present invention.

Figure 2:
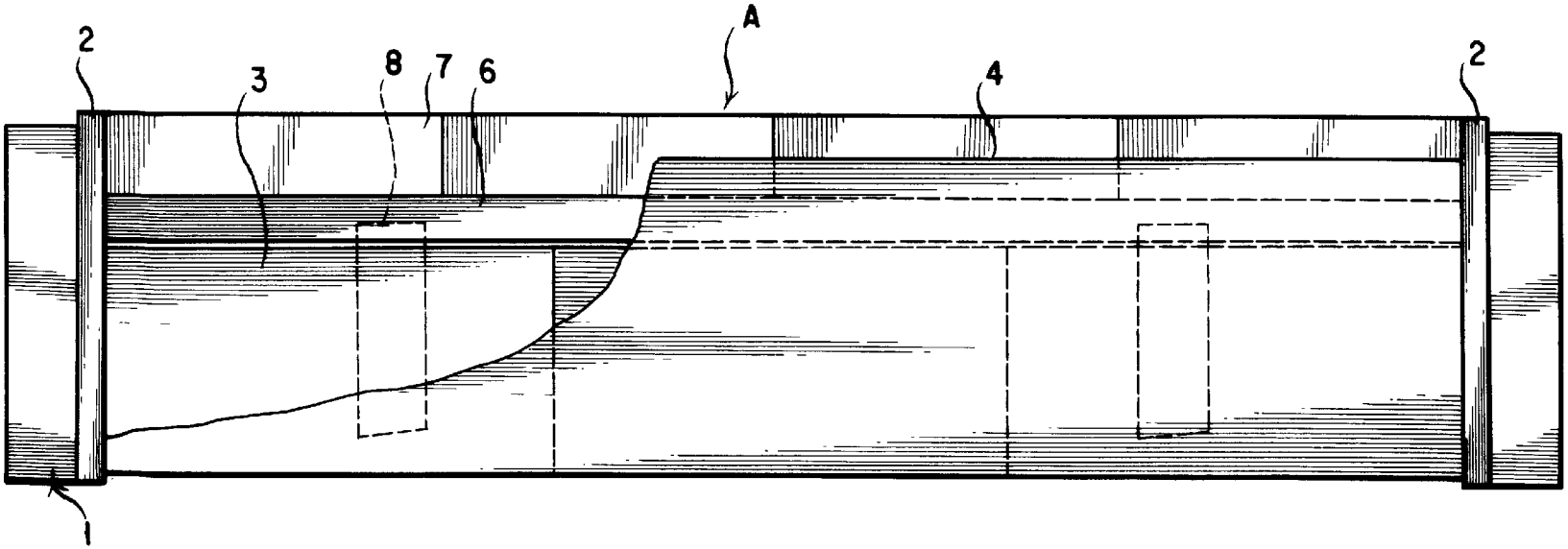
FIG. 2 is a top plan of the ink fountain, with a part shown broken away to reveal other parts, of the ink supply apparatus.
Figure 3:
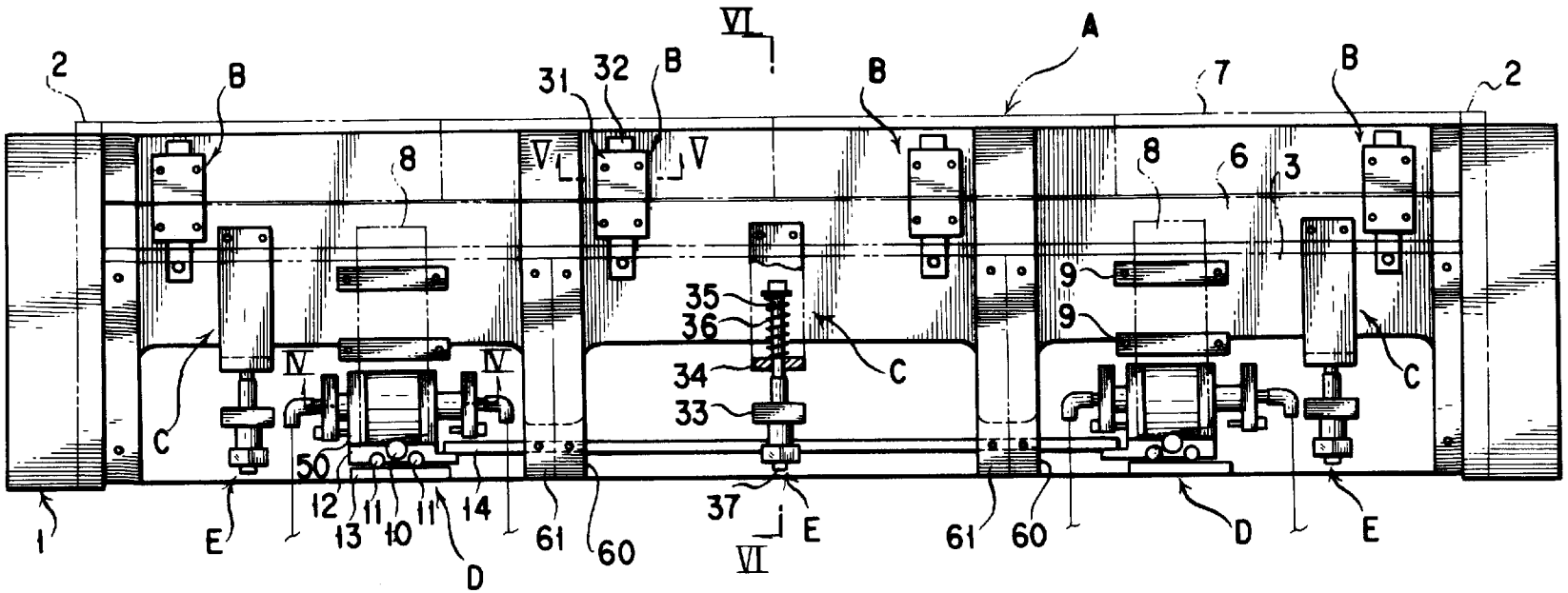
FIG. 3 is a section through the ink fountain, taken along the line III—III in FIG. 1.

As will be noted from FIGS. 1–3, the ink fountain 1 is of substantially greater dimension along the axis of the fountain roller K than in a direction at right angles therewith. The elongate ink fountain 1 has part of its bottom formed by a similarly elongate blade assembly A which is movable relative to the rest of the ink fountain toward and away from the fountain roller K to close and open the ink outlet J defined by and between the blade assembly and the surface of the fountain roller.

As best revealed by FIG. 3, the ink fountain 1 has mounted on its underside various means suggested by this invention for moving the blade assembly A into and out of leak-free contact with the fountain roller K. Such means include blade guide means B for positively guiding the travel of the blade assembly A in a direction normal to the axis of the fountain roller K, a plurality of, three in the illustrated embodiment, spring assemblies C acting between ink fountain and blade assembly for yieldably urging the blade assembly away from the fountain roller in order to open the ink outlet J, a plurality of, two in the illustrated embodiment, blade drive mechanisms D for moving the blade assembly into engagement with the surface of the fountain roller against the bias of the spring assemblies in order to close the ink outlet, and adjustable stop means E for limiting the retraction of the blade assembly away from the fountain roller under the forces of the spring assemblies C, for adjustably varying the degree to which the ink outlet J is opened, and for permitting manual readjustment, as required, of the attitude of the retracted blade assembly into exact parallelism with the surface of the fountain roller.

Hereinafter in this specification the noted ink fountain 1, blade assembly A, blade guide means B, spring assemblies C, blade drive mechanisms D, and adjustable stop means E of the ink supply apparatus S will be discussed in more detail in that order and under separate headings. The operational description of the apparatus will follow the detailed discussion of the listed components.

Ink Fountain

With reference to FIGS. 1–3 the ink fountain 1 comprises a pair of opposite end walls 2 and a bottom 3 extending therebetween and sloping downwardly as it extends toward the fountain roller K. The sloping bottom 3 may be considered serving also as one side of the ink fountain, the other side being closed by the fountain roller K. The pair of end walls 2 extend toward the fountain roller K to a greater extent than does the bottom 3, leaving a space between the bottom and the fountain roller for installation, as well as reciprocation, of the blade assembly A in coplanar relationship to the bottom. A bottom cover 4 in the form of a thin flat plate covers the bottom 3 and part of the blade assembly A. The ink contained in the ink fountain 1 is shown at 5.

Blade Assembly

FIG. 1 best indicates that the blade assembly A is disposed between the fountain bottom 3 and the fountain roller K in coplanar relationship to the former and, as shown in FIG. 2, extends between the pair of fountain end walls 2. Thus the blade assembly A forms part of the fountain bottom in this particular embodiment, although it could solely constitute the fountain bottom. The blade assembly A is movable, with its coplanar relationship to the fountain bottom unchanged, toward and away from the fountain roller K to close and open the ink outlet J. In FIG. 1 is shown the blade assembly A held against the surface of the fountain roller K thereby closing the ink outlet J. The blade assembly A is movably supported on the ink fountain 1 by both blade guide means B and blade drive mechanisms D in a manner to be detailed subsequently.

Preferably, and as pictured in FIGS. 1 and 2, the blade assembly A is constituted of a blade carrier 6 and a plurality of, four in the illustrated embodiment, discrete blade sections 7 individually fastened to the front edge of the blade carrier in alignment along the fountain roller axis for direct abutment against the fountain roller K when the ink outlet J is closed. The positions of the blade sections 7 are adjustably variable within relatively narrow limits on the blade carrier 6 toward and away from the fountain roller K for close contact therewith all along its axial dimension.

Blade Guide Means

Figure 5:
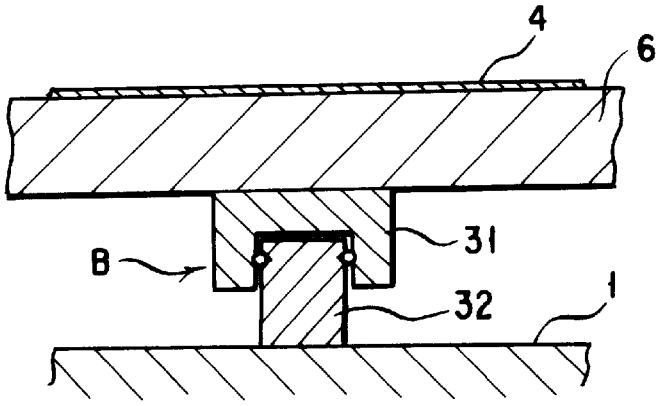
FIG. 5 is an enlarged section through the ink fountain, taken along the line V—V in FIG. 3 and showing in particular one of the guide means for guiding the blade assembly toward and away from the fountain roller in FIG. 1 apparatus.

As shown in FIG. 3, the four blade guide means B are arranged in positions of bilateral symmetry on the ink fountain 1 with respect to the midpoint of its longitudinal dimension. All the blade guide means B are identical in construction, so that the description of one applies to each of the others. With reference therefore to FIG. 5, which illustrates one representative blade guide means B in cross section, it will be seen that it comprises a shoe 31 of U shaped cross section mounted fast to the underside of the blade carrier 6 of the blade assembly A, and a guide rail 32 mounted fast to a stationary part of the ink fountain 1 and extending at right angles with the fountain roller axis.

The shoes 31 of all the blade guide means B are slidably or rollably mounted astride the respective guide rails 32. All the shoes 31 are to jointly slide or roll along the guide rails 32, assuring smooth travel of the blade assembly A toward and away from the fountain roller K.

Spring Assemblies

One of the three spring assemblies C shown in FIG. 3 by way of example is disposed centrally on the ink fountain 1 with respect to its longitudinal dimension, and the other two in symmetrical positions on both sides of the central one. All the three are also of identical make, so that only one of them will be detailed with reference to FIG. 6, it being understood that the same description applies to each other.

On the underside of the ink fountain bottom 3 there are provided a bracket 33 having a tapped hole 33*a*, and another bracket 34 having a clearance hole 34*a*. The first recited bracket 33 is affixed to the fountain bottom 3, and the second bracket 34 to the blade carrier 6, with the holes 33*a* and 34*a* aligned normal to the fountain roller axis. A bolt 35 is inserted into and through the clearance hole 34*a* and threaded into and through the tapped hole 33*a*, and a nut or nuts 38 are fitted over the bolt end portion projecting from the tapped hole. Sleeved upon the shank of the bolt 35, a helical compression spring 36 extends between the bolt head and the bracket 34 fastened to the blade assembly A.

It is thus seen that the blade assembly A is biased away from the fountain roller K by the compression springs 36 of the three spring assemblies C, tending to open the ink outlet J. The forces of the springs 36 are made individually adjustable by turning the nuts on the bolts 35, in order to maintain the blade assembly A parallel to the surface of the fountain roller K.

Blade Drive Mechanisms

Disposed symmetrically on both sides of the longitudinal midpoint of the ink fountain 1, the pair of blade drive mechanisms D seen in FIG. 3 coact to drive the blade assembly A into abutment against the fountain roller K in opposition to the forces of the compression springs 36 and to permit the blade assembly to be sprung away from the fountain roller. The two blade drive mechanisms are alike in construction, so that the description of one applies to the other.

Figure 4:
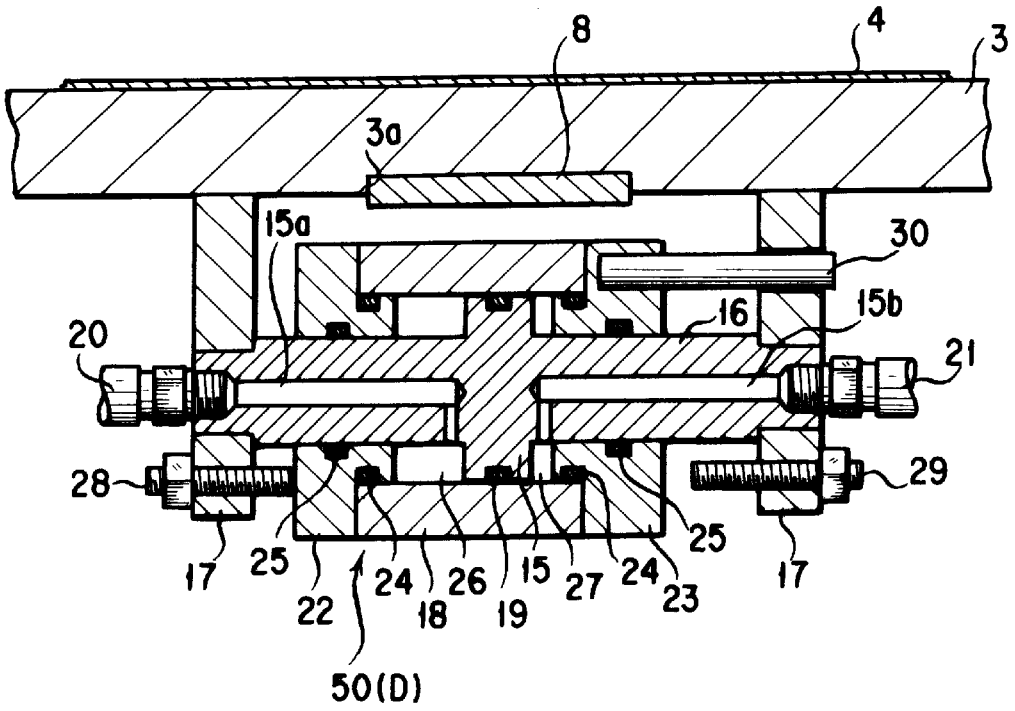
FIG. 4 is an enlarged section through the ink fountain, taken along the line IV—IV in FIG. 3 and showing in particular one of the double-ended rod fluid actuators.
Figure 6:
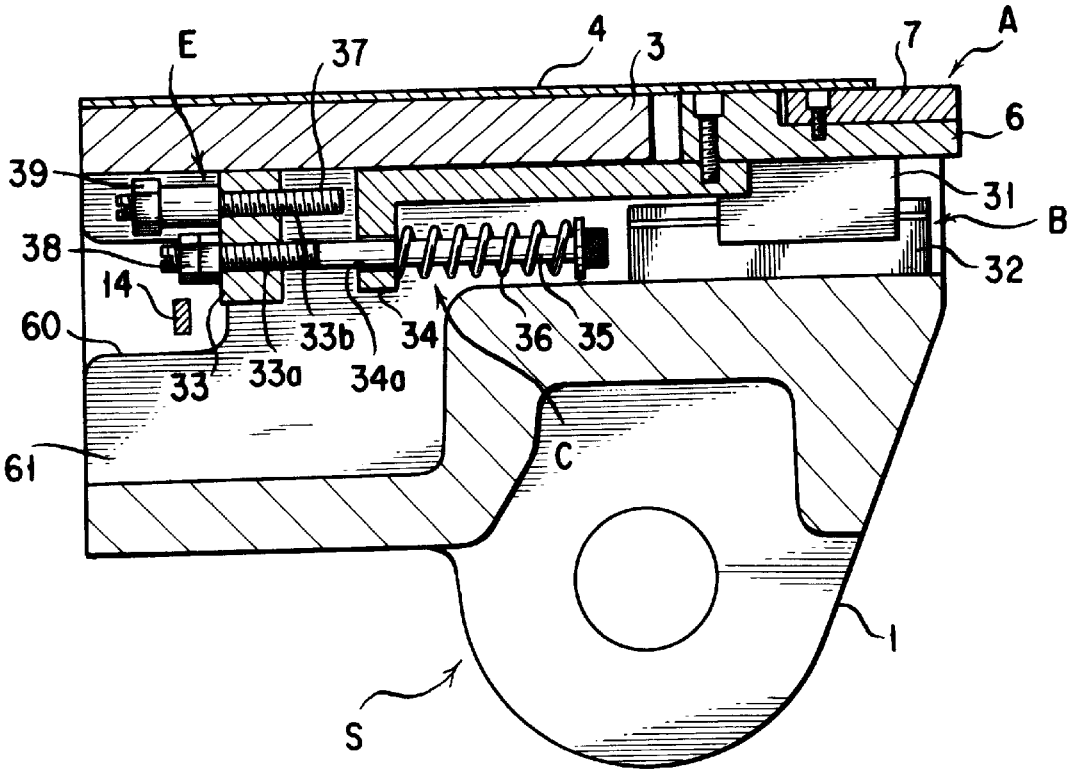
FIG. 6 is also an enlarged section through the ink fountain, taken along the line VI—VI in FIG. 3 and showing in particular one of the spring assemblies for biasing the blade assembly away from the fountain roller.
Figure 7:
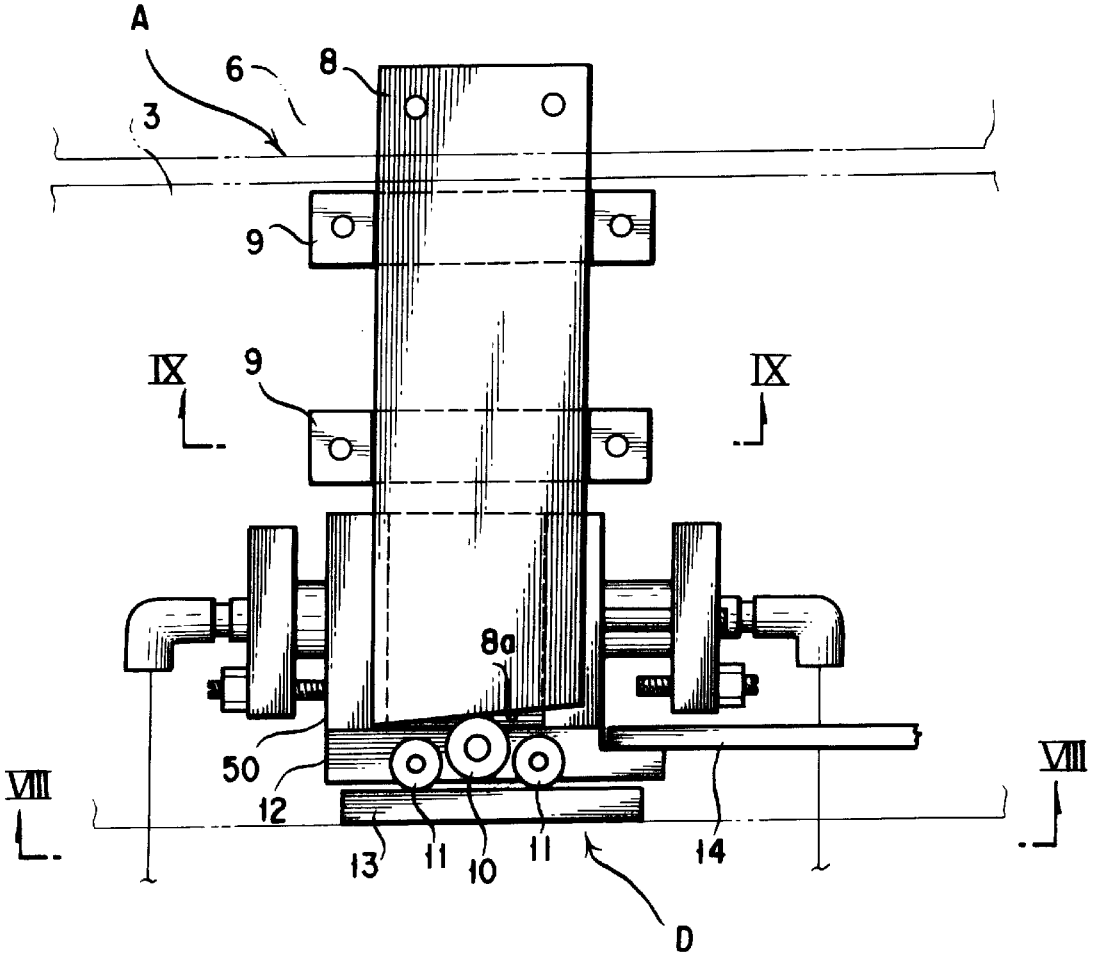
FIG. 7 is an enlarged plan of one of the blade drive means of the FIG. 1 apparatus.
Figure 8:
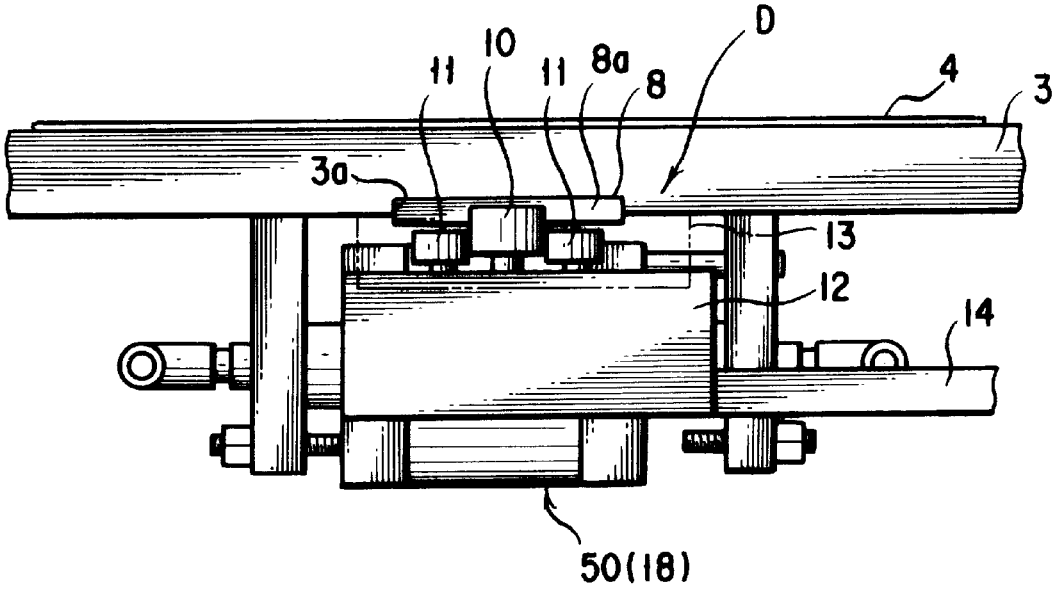
FIG. 8 is an end elevation of one of the blade drive means, seen in the direction of the arrows VIII in FIG. 7.
Figure 9:
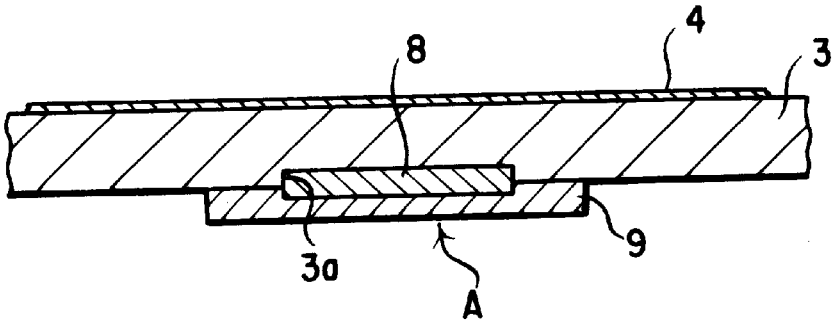
FIG. 9 is a section through one of the blade drive means, taken along the line IX—IX in FIG. 7.

While the blade drive mechanisms D appear in both FIGS. 1 and 3, one representative mechanism is illustrated on an enlarged scale in FIGS. 4, 7 and 8 and in part in FIG. 9. Broadly, the representative blade drive mechanism D comprises a blade pusher 8 slidably mounted to the underside of the ink fountain bottom 3 and coupled to the blade assembly A for linear travel therewith toward and away from the fountain roller K, and a linear actuator 50 operatively coupled to the blade pusher 8 for moving the same toward the fountain roller against the forces of the compression springs 36, FIG. 6, of the spring assemblies C.

The blade pusher 8 is in the form of a strip of sheet metal slidably engaged in a guide groove 3*a* in the fountain bottom 3 and restrained from disengagement therefrom by staples 9. As will be noted from FIGS. 1 and 7, one end of the blade pusher 8 is screwed or otherwise fastened to the blade carrier 6. The other end of the blade pusher 8 is cut at an angle to provide a cam edge 8*a*, FIG. 7, in order to be forced toward the fountain roller K by the linear actuator 50 in a manner yet to be described.

In this particular embodiment of the invention the linear actuator 50 takes the form of a double-ended-rod fluid actuator best illustrated in FIG. 4. Itself of known construction, the fluid actuator 50 comprises a piston 15 having a double-ended piston rod 16 and relatively slidably received in a cylinder 18. Immovably supported by and between a pair of lugs 17 depending from the fountain bottom 3, the double-ended rod 16 extends parallel to the axis of the fountain roller K. It is therefore the cylinder 18, not the double-ended piston rod 16, that forms the output member of this fluid actuator, reciprocating relative to the ink fountain 1 in a direction parallel to the fountain roller axis. This linear travel of the cylinder 18 is transmitted to the blade pusher 8 by means including the cam edge 8*a*, causing the blade pusher to travel normal to the fountain roller axis.

The fluid actuator 50 has a sealing ring 19 on the piston 15 for fluid-tight contact with the cylinder 18, sealing rings 24 on a pair of end caps 22 and 23 for fluid-tightly closing the opposite ends of the cylinder, and sealing rings 25 on the insides of the end caps for permitting the double-ended piston rod 16 to extend slidably but fluid-tightly therethrough. There are thus defined a pair of fluid-tight chambers 26 and 27 on both sides of the piston 15 within the cylinder 18.

For supply and discharge of a fluid under pressure to and from the fluid chambers 26 and 27, a pair of fluid passageways 15*a* and 15*b* extend axially through the piston rod 16 and open to the respective fluid chambers. Joints 20 and 21 are respectively coupled to the ends of the piston rod 16 for communicating the fluid passageways 15*a* and 15*b* with a pressurized fluid source, not shown, via a directional control valve, also not shown. Preferably solenoid operated, this unshown valve is to place the pair of fluid chambers 26 and 27 alternately in communication with the unshown pressurized fluid source and with a fluid drain. The cylinder 18 is to travel back and forth on the double-ended piston rod 16 with the alternate supply and discharge of the pressurized fluid to and from the fluid chambers 26 and 27.

At 28 and 29 in FIG. 4 are seen a pair of adjustable stops for limiting the stroke of the cylinder 18. The adjustable stops 28 and 29 are shown as threaded rods engaged in tapped holes in the depending lugs 17 on the fountain bottom 3, for abutting engagement with the end caps 22 and 23 of the cylinder 18. The stroke of the cylinder 18 as well as its terminal positions is therefore adjustably variable by turning the threaded rods 28 and 29 in either direction.

FIG. 4 also shows at 30 a detent projecting from the cylinder 18 in a direction parallel to the fountain roller axis and slidably inserted in and through a. hole in one of the lugs 17. The detent serves primarily to prevent the cylinder 18 from angular displacement during its travel in either direction along the double-ended rod 16.

As seen in FIGS. 1, 3, 7 and 8, in order to translate the linear travel of the cylinder 18 parallel to the fountain roller axis into that of the blade pusher 8 normal to the fountain roller axis, a drive roller 10 is rotatably mounted centrally on a roller carrier 12 which is secured to the cylinder 18. The drive roller 10 makes rolling engagement with the noted cam edge 8*a* of the blade pusher 8 as the latter is energized against the drive roller under the influence of the compression springs 36, FIGS. 3 and 6.

Also rotatably mounted on the roller carrier 12 are a pair of rollers 11 which are disposed on opposite sides of the drive roller 10 and which are rollably held against an abutment 13 formed on the underside of the fountain bottom 3 and extending parallel to the fountain roller axis. The abutment 13 is intended to bear against the thrust of the blade pusher 8 retracting under the forces of the compression springs 36, without interfering with the smooth travel of the cylinder 18 together with the drive roller 10.

As has been stated with reference to FIG. 2 the illustrated ink supply apparatus employs the two blade drive mechanisms D, each constructed as in the foregoing, for conjointly moving the blade assembly A into and out of leak-free engagement with the fountain roller K. This objective demands, among other factors, exact synchronization of the fluid actuators 50. It is to meet this requirement that the fluid actuators 50 are aligned parallel to the fountain roller axis. For, by virtue of this arrangement, the two fluid actuators 50 are exactly synchronizable merely by rigidly interconnecting the cylinders 18, the output members of the fluid actuators 50 with a link 14. Extending with large clearances through recesses 60 in reinforcing webs 61 of the ink fountain 1, the link 14 does not in any way interfere with the fountain or any other parts of the apparatus.

Adjustable Stop Means

Of the two adjustable stop means of identical make shown at E in FIG. 3, one is shown on an enlarged scale in FIG. 6. Included is a stop in the form of a threaded rod 37 engaged in a tapped hole 33*b* which is created in the first bracket 33, set forth in connection with the spring assemblies C, in parallel spaced relationship to the tapped hole 33*a* also formed in the same bracket. The position of the threaded stop rod 37 is adjustably variable in its axial direction relative to the bracket 33 by loosening or tightening a nut 39 thereon. The stop 37 is to be abutted upon by the second bracket 34 upon retraction of the blade assembly A under the forces of the compression springs 36.

Such being the construction of each adjustable stop means E, the two such means shown in FIG. 3 coact to perform the three important functions set forth already. It will also be appreciated that the spring assemblies C and the stop means E share the brackets 33 and 34, minimizing parts that are required by them.

Operation

Held closed as shown in FIG. 1 when the printing press is out of operation, the ink outlet J is to be opened automatically when the machine is set into operation. To this end the unshown solenoid valve is actuated to deliver a fluid under pressure to the right hand fluid chambers 27, FIG. 4, of both fluid actuators 50. Thereupon the cylinders 18 will travel to the right on the double-ended piston rods 16, together with the roller carriers 12 attached thereto.

As will be best understood from FIG. 7, the drive rollers 10 on the roller carriers 12 will then travel in rolling contact with the cam edges 8*a* of the blade pushers 8, and the other two rollers 11 on each roller carrier in rolling contact with the abutment 13. The cam edges 8*a* are so angled that the blade pushers 8, as well as the blade assembly A fastened thereto, will travel away from the fountain roller K under the forces of the compression springs 36, FIG. 6.

The retraction of the blade assembly A will come to an end upon abutment of the brackets 34, fastened to the blade assembly as shown in FIG. 6, against the adjustable stops 37. Now is fully opened the ink outlet J. The blade assembly A will be stopped in exactly parallel relationship to the fountain roller K as the three adjustable stops 37 equally bear against the retraction of the blade assembly. The ink 5 will therefore form a film of unvarying thickness on the surface of the fountain roller K, which is understood to have been set into rotation with the commencement of machine operation, throughout its axial dimension.

When the machine is set out of operation upon completion of a required run of printing, the unshown solenoid valve is to be reactuated to place the right hand fluid chambers 27 of both fluid actuators 50 in communication with the fluid drain, and their left hand fluid chambers 26 in communication with the unshown pressurized fluid source. The cylinders 18 will then travel back to the position of FIGS. 4 and 7. During this, leftward travel, as seen in these figures, of the cylinders 18, the drive rollers 10 on the roller carriers 12 will roll over the cam edges 8*a* of the blade pushers 8 thereby causing the same to travel upward, as viewed in FIGS. 3 and 7, against the biases of the compression springs 36.

Now has the blade assembly A been brought back to the FIG. 1 position, closing the ink outlet J by making fluid-tight abutting engagement with the fountain roller K. It will be appreciated that, rigidly interconnected by the link 14, the cylinders 18 of both fluid actuators 50 are constrained to exact synchronism in traveling back and forth on the piston rods 16. Consequently, guided by the guide means B, the blade assembly A will travel smoothly and evenly throughout its length into leak-free contact with the fountain roller K.

Notwithstanding the foregoing detailed disclosure, it is not desired that the present invention be limited by the exact showing of the drawings or by the description thereof. For instance, the double-ended rod fluid actuators for driving the blade assembly could be replaced by various other actuators, provided that such actuators can be mechanically linked together for synchronous operation. This and other modifications, alterations and substitutions of the invention may be resorted to without departing from the scope of the invention as expressed in the subjoined claims.

What is claimed is:

1. A leak-free, constant-rate ink supply apparatus for keyless printing, comprising:

(a) a fountain roller;

(b) an ink fountain having one side closed by a surface of the fountain roller;

(c) blade means forming at least part of a bottom of the ink fountain and movable toward and away from the surface of the fountain roller for closing and opening an ink outlet defined by and between the fountain roller and the blade means;

(d) resilient means acting between the ink fountain and the blade means for urging the blade means away from the fountain roller in order to open the ink outlet;

(e) a plurality of blade drive means disposed in spaced positions along an axis of the fountain roller and acting between the ink fountain and the blade means for moving the blade means into engagement with the surface of the fountain roller against the force of the resilient means in order to close the ink outlet; and (f) link means mechanically linking the blade drive means to each other for synchronizing the operations thereof and hence for assuring leak-free contact of the blade means with the fountain roller.

2. The ink supply apparatus of claim 1 wherein each blade drive means comprises:

(a) a blade pusher coupled to the blade means and constrained to linear travel with the blade means toward and away from the fountain roller relative to the ink fountain;

(b) a linear actuator mounted to the ink fountain and having an output member reciprocably movable relative to the ink fountain in a direction parallel to the axis of the fountain roller, the output members of the linear actuators of all the blade drive means being linked to each other by the link means; and (c) cam means for translating the motion of the output member of the linear actuator in the direction parallel to the axis of the fountain roller into the motion of the blade pusher at right angles with the axis of the fountain roller.

3. The ink supply apparatus of claim 2 wherein the cam means of each blade drive means comprises:

(a) a cam edge with which the blade pusher is formed at one end thereof; and (b) a drive roller movable with the output member of the linear actuator in rolling engagement with the cam edge of the blade pusher.

4. The ink supply apparatus of claim 2 wherein the linear actuator of each blade drive means is a double-ended-rod fluid actuator comprising:

(a) a double-ended rod immovably mounted to the ink fountain;

(b) a piston formed on the double-ended rod; and (c) the output member in the form of a cylinder slidably fitted over the piston so as to define a pair of fluid chambers on opposite sides of the piston, the cylinder being capable of linear reciprocation relative to the ink fountain in a direction parallel to the axis of the fountain roller.

5. The ink supply apparatus of claim 4 wherein the link means comprises a link rigidly interconnecting the cylinders of the linear actuators of all the blade drive means.

6. The ink supply apparatus of claim 4 wherein each blade drive means further comprises adjustable stop means for adjustably limiting the stroke of the cylinder in either direction.

7. The ink supply apparatus of claim 1 further comprising a plurality of blade guide means disposed in spaced positions along the axis of the fountain roller for guiding the travel of the blade means toward and away from the fountain roller.

8. The ink supply apparatus of claim 1 further comprising adjustable stop means for adjustably limiting the travel of the blade means away from the fountain roller under the force of the resilient means.

9. The ink supply apparatus of claim 1 wherein the resilient means comprises a plurality of spring assemblies disposed in spaced positions along the axis of the fountain roller, each spring assembly comprising:

(a) a first bracket secured to the ink fountain;

(b) a second bracket secured to the blade means;

(c) a threaded member extending through a hole in the first bracket in threaded engagement therewith and through a hole in the second bracket with clearance; and (d) a spring sleeved upon the threaded member for biasing the blade means away from the fountain roller.

10. The ink supply apparatus of claim 9 further comprising adjustable stop means for adjustably limiting the travel of the blade means away from the fountain roller under the force of the resilient means, the adjustable stop means comprising a second threaded member extending through a second hole in the first bracket in threaded engagement therewith, the second bracket being movable into abutment against the second threaded member with the travel of the blade means away from the fountain roller.

11. A leak-free, constant-rate ink supply apparatus for keyless printing, comprising:

(a) a fountain roller;

(b) an ink fountain having one side closed by a surface of the fountain roller;

(c) blade means forming at least part of a bottom of the ink fountain and movable toward and away from the surface of the fountain roller for closing and opening an ink outlet defined by and between the fountain roller and the blade means;

(d) at least two blade pushers coupled to the blade means in spaced positions along an axis of the fountain roller and constrained to linear travel with the blade means toward and away from the fountain roller relative to the ink fountain;

(e) at least two linear actuators mounted to the ink fountain in the adjacencies of the respective blade pushers and each having an output member reciprocably movable relative to the ink fountain in a direction parallel to the axis of the fountain roller;

(f) cam means for translating the reciprocating motion of the output member of each linear actuator parallel to the fountain roller axis into the reciprocating motion of one of the blade pushers at right angles with the fountain roller axis; and (g) a link rigidly linking the output members of the linear actuators to each other for synchronizing the operations thereof and of the blade pushers and hence for assuring leak-free contact of the blade means with the fountain roller.

12. A leak-free, constant-rate ink supply apparatus for keyless printing, comprising:

(a) a fountain roller;

(b) an ink fountain having a bottom and having one side closed by a surface of the fountain roller;

(c) blade means disposed alongside the bottom of the ink fountain and defining in combination with the fountain roller an ink outlet which is to be closed and opened as the blade means travels toward and away from the surface of the fountain roller;

(d) resilient means acting between the ink fountain and the blade means for urging the blade means away from the fountain roller in order to open the ink outlet;

(e) at least two blade pushers mounted to the bottom of the ink fountain and coupled to the blade means in spaced positions along an axis of the fountain roller, the blade pushers being constrained to linear travel with the blade means toward and away from the fountain roller relative to the ink fountain;

(f) at least two linear actuators mounted to the bottom of the ink fountain and each having an output member reciprocably movable relative to the ink fountain in a direction parallel to the axis of the fountain roller;

(g) cam means for transmitting the motion of the output member of each linear actuator to one of the blade pushers in order to cause the blade means to travel toward the fountain roller against the force of the resilient means and away from the fountain roller under the force of the resilient means; and (h) a link rigidly interconnecting the output members of the linear actuators in order to cause the blade means to travel into leak-free contact with the surface of the fountain roller.

13. The ink supply apparatus of claim 12 further comprising a plurality of adjustable stop means disposed in spaced positions along the axis of the fountain roller for arresting the travel of the blade means away from the fountain roller under the force of the resilient means, the stop means being independently adjustable toward and away from the fountain roller for holding the blade means parallel to the surface of the fountain roller.

* * * * *